United States Patent [19]

Löf

[11] Patent Number: 5,052,503

[45] Date of Patent: Oct. 1, 1991

[54] ECCENTRIC DRILLING TOOL

[75] Inventor: Stig U. Löf, Sunne, Sweden

[73] Assignee: Uniroc Aktiebolag, Fagersta, Sweden

[21] Appl. No.: 503,540

[22] Filed: Apr. 3, 1990

[30] Foreign Application Priority Data

Apr. 5, 1989 [SE] Sweden ..... 8901199

[51] Int. Cl.[5] ..... E21B 10/40; E21B 10/66

[52] U.S. Cl. ..... 175/258; 175/292; 175/389; 175/398; 175/415

[58] Field of Search ..... 175/258, 292, 398, 171, 175/257, 385, 399, 415, 410, 408, 406, 416, 389, 390, 391

[56] References Cited

U.S. PATENT DOCUMENTS

| | | | |
|---|---|---|---|
| 1,463,566 | 7/1923 | Akino | 175/389 |
| 3,163,243 | 12/1964 | Cleary | 175/399 X |
| 3,416,616 | 12/1968 | Ahlgren | 175/258 |
| 3,648,789 | 3/1972 | Eriksson | 175/292 |
| 3,753,470 | 8/1973 | Lagerstrom et al. | 175/292 |
| 3,848,683 | 11/1974 | Persson | 175/258 X |
| 3,851,719 | 12/1974 | Thompson et al. | 175/406 |
| 3,870,114 | 3/1975 | Pulk et al. | 175/390 X |
| 4,196,783 | 4/1980 | Lof | 175/408 |
| 4,408,669 | 10/1983 | Wiredal | 175/258 |
| 4,440,244 | 4/1984 | Wiredal | 175/292 |
| 4,765,416 | 8/1988 | Bjerking et al. | 175/385 X |
| 4,817,741 | 4/1989 | Lof | 175/398 |
| 5,009,274 | 4/1991 | Lof | 175/260 |

FOREIGN PATENT DOCUMENTS

| | | | |
|---|---|---|---|
| 2031481 | 4/1980 | United Kingdom | 175/410 |
| 2147036 | 5/1985 | United Kingdom | 175/258 |

*Primary Examiner*—Hoang C. Dang

*Attorney, Agent, or Firm*—Eric Y. Munson; Mark P. Stone

[57] ABSTRACT

An eccentric drilling tool comprises a guide member (10) rotatably centered by the mouth of a casing tube (11) that follows the tool downhole during drilling. A pilot bit (23) on the guide member (10) is provided with axially oriented hard metal pilot button inserts (57, 57$^{I}$–57$^{III}$) peripherally thereon directed to define the diameter of the pilot hole to be cut during drilling. A laterally extending eccentric bit (22) behind said pilot bit (23) has axially oriented hard metal reaming button inserts (48–51) at the eccentric top portion thereof directed to ream up the pilot hole to a maximum diameter. The eccentric bit (22) is movably supported relative to said guide member (10) between a drilling position, in which the eccentric bit (22) projects laterally beyond said casing tube (11) so as to drill jointly with said pilot bit (23) a hole larger than said casing tube (11), and a retracted position, in which the drill bit can be retracted or lowered through the casing tube (11). In order to counteract radial deviation of the pilot bit (23) during drilling, the frontal quadrant (between 57$^{I}$,57) thereof, which lies diametrically opposite to the reaming inserts (48,51) of the eccentric bit (22) that lead in the rotational direction (8) of the tool, is left void of peripheral diameter cutting pilot buttons.

12 Claims, 2 Drawing Sheets

ECCENTRIC DRILLING TOOL

BACKGROUND OF THE INVENTION

The present invention relates to eccentric drilling tools for combined rotary and percussive drilling in earth and in rock covered by overburden concurrently with a casing tube following the drilling tool downhole, and more particularly to the type of such drilling tools wherein a guide member is rotatably centered by the mouth of the casing tube, a pilot bit at the forward end of said tool is supported by the guide member and provided with axially oriented hard metal pilot insert means peripherally thereon directed to define the diameter of the pilot hole to be cut during drilling, a laterally extending eccentric bit behind said pilot bit on the tool carries axially oriented hard metal reamer insert means at the eccentric top thereof directed to ream up the pilot hole to the maximum diameter of the hole drilled, and the eccentric bit is movably supported relative to said guide member between a drilling position, in which the eccentric bit projects laterally beyond said casing tube so as to drill jointly with the pilot bit a hole larger than the casing tube, and a retracted position, in which the drilling tool can be retracted or lowered through the casing tube.

Drilling tools of this type are disclosed inter alia in U.S. Pat. publications 3,753,470, 3,848,683, and 4,440,244. In these tools the greater part of the drilling work falls on the insert means that have the longest distance to travel during work, i.e. on the reamer insert means at or close to the maximum diameter worked. In that region primarily the insert means leading in the rotational direction of the tool is the one that has to, or in case of radially staggered plural insert means, are the ones that have to carry the maximum load since being the first to "break up" the hole radially to its full dimension Under the action of the rotary drive torque and the vibrations during drilling, the load on these leading inserts tends to turn the eccentric bit in the rotational drilling direction with the leading insert means as central point. As a result there is created an undesirable wear of the pilot bit towards a gradual reduction of the maximum diameter drilled until finally the casing tube gets stuck.

SUMMARY OF THE INVENTION

It is the main object of the invention to remedy the problem outlined by eliminating radial deviation and wear of the pilot bit of an eccentric drilling tool as a result of load acting on eccentric reamer insert means of the tool during drilling. A further object of the invention is to optimise the inventive solution by an advantageous application of hard metal buttons as insert means. A further object is to apply the inventive solution in an eccentric drilling tool of improved design able to support the insert buttons with increased sturdiness. These and ancillary objects are attained by the inventive features defined in the appended claims.

DESCRIPTION OF THE BEST MODES FOR CARRYING OUT THE INVENTION

Figure 1:
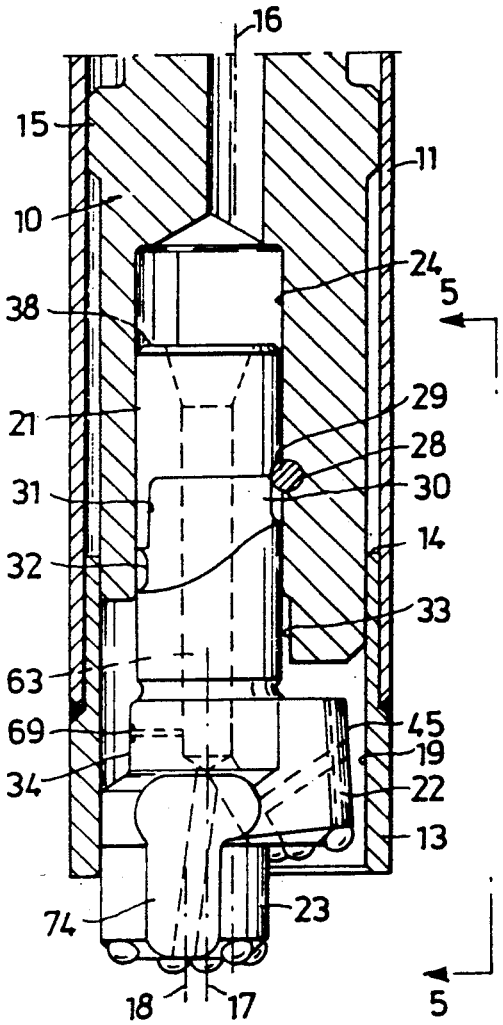
Figure 2:
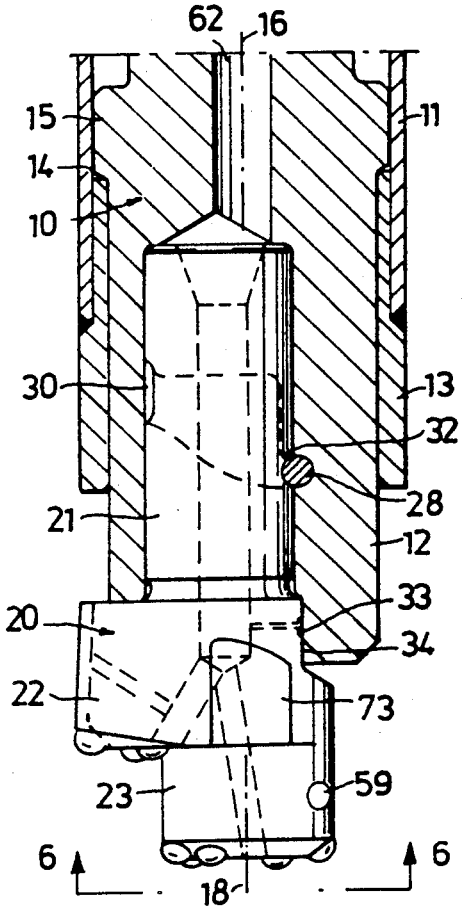
Figure 3:
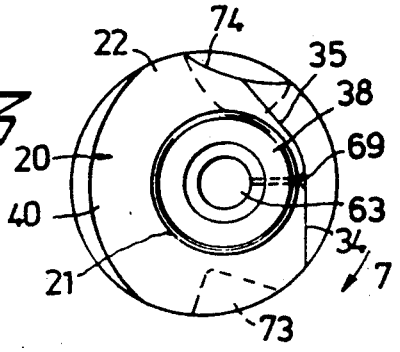
Figure 4:
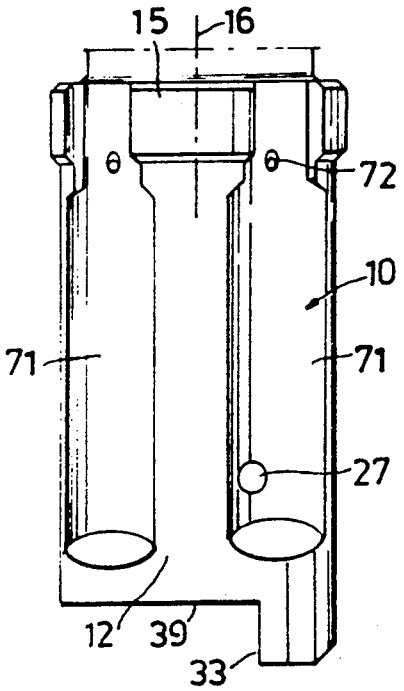
Figure 5:
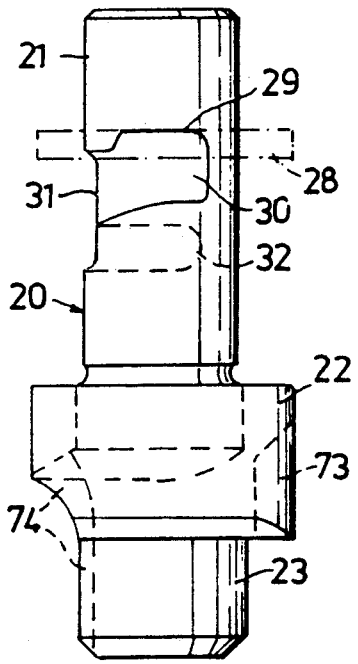
Figure 6:
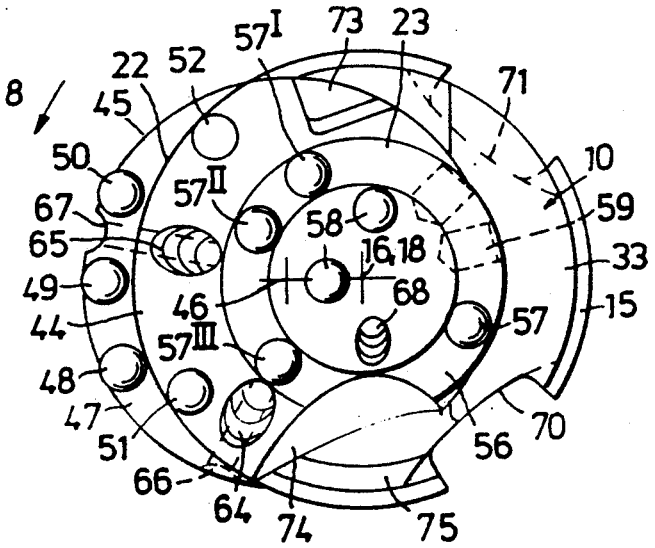

An embodiment of the invention is described hereinafter with reference to the enclosed drawings, wherein FIG. 1 shows the drilling tool in cross section during passage of the guide member through the casing tube with a drill bit, shown in side view, hanging down therefrom in retracted position. FIG. 2 shows a corresponding view with the drill bit in drilling position adjacent to the guide member which is supported in the casing shoe at the mouth of the casing tube. FIG. 3 is a rear end view of the drill bit in FIG. 2. FIG. 4 is a side view of the guide member in FIG. 2. FIG. 5 is a side view of the drill bit in FIG. 1 seen in the direction of arrows 5—5. FIG. 6 is a somewhat enlarged end view of the drill bit and guide member in FIG. 2 seen in the direction of arrows 6—6.

The guide member 10 is in the usual way coupled to a drill string extending through the casing tube 11. In the example shown the drill string rotates the guide member 10 in the clockwise direction when viewed from above and delivers impact energy thereto from a tophammer above ground or from a downhole drill coupled in impact generating position between the drill string and the guide member 10. The drill string and the parts associated therewith are conventional and not shown in the drawings.

The guide member 10 has a cylindrical guide portion 12 which with a centering fit is guided by the mouth of the casing tube 11 for rotation coaxially with the' drilling axis 16. In the example shown illustrating drive by a down-the-hole drill, the mouth of the casing tube has welded thereon a guide shoe 13, which provides an internal shoulder 14 in the casing tube and a cylindrical guide opening for the guide portion 12. The guide member 10 has axial abutments 15 at the rear thereon abutting on the shoulder 14 whereby part of the impact power from the downhole drill is transmitted to drive down the casing tube 11, FIG. 2.

A drill bit 20 consists integrally of an axially protruding pilot bit 23, a sidewise projecting eccentric bit 22, and a rear shaft 21. The shaft 21 extends pivotally and axially movably into an eccentrically disposed bore 24 in the guide member 10 and is pivotally journalled in the guide member 10 in and around the axis 17 of the bore 24 extending in laterally spaced and parallel relation to the drilling axis 16. The pilot bit 23 in its turn is centered on an axis 18 which is parallel with the axes 16,17 but has the double lateral spacing to the drilling axis 16 in comparison with the shaft axis 17.

Axially spaced peripheral end grooves 30,32 extend in opposite direction from an axial cam groove 31 on the shaft 21 and are engaged by a follower 28 such as a pin inserted in a transverse bore 27 in the guide member 10, the follower 28 defining positively the axial and angular movability and positions of the guide member 10 relative to the drill bit 20. In the forward end groove 32 the follower 28 maintains the drill bit 20 axially in drilling position, FIG. 2, adjacent to the guide member 10 with the eccentric bit 22 protruding to drill a hole larger than the casing tube 11. In such drilling position a shoulder 33 on the guide member abuts against a mating transverse abutment 34, FIG. 3, on the drill bit 20 and transmits drilling rotation (arrow 7) thereto. The abutment 34 is slanted at 35 for allowing the shoulder 33 to turn away from or to enter the abutment 34. During drilling the impacts are applied by the bottom of the bore 24 to the end 38 of the shaft 21 and by the axial face 39 of the guide member 10 to the back 40 of the eccentric bit 22.

In an intermediate position 90° away from the drilling position, the follower 28 enters the cam groove 31 whereby the guide member 10 becomes axially movable the distance between the end grooves 30,32. In a rear axial position the guide member 10, by a continued 90° turn, brings the follower into the rear end groove 30 to axially define the retracted position, FIG. 1, of the drill bit 20, wherein the tool can be raised or lowered freely through the casing tube 11. In the retracted raised position the drill bit 20 is hanging freely on the follower pin 28 which enters an arresting groove 29 behind the rear end groove 30 and keeps the drill bit bidirectionally arrested against rotation relative to the guide member 10.

The drilling tool drills by means of insert means, preferably tungsten carbide buttons fitted on the front surfaces of the pilot and eccentric bits 23,22 as shown in FIG. 6. The eccentric bit 22 has planar back and front surface 40,44, a laterally protruding partly conical rearwardly-inwardly slanting mantle surface 45 having a central cone axis at 46, and a sickle shaped transition chamfer 47 that joins the front surface 44. The chamfer 47 carries at the maximal protrusion or central plane (through the axes 17,18) of the eccentric bit 22 two or, as in the example shown, three outwardly slanted symmetrically arranged hard metal reamer buttons 48,49,50 which at drilling cut the maximum diameter of the tool. Leading in the rotational direction (arrow 8) is positioned an axial reamer button 51 on the front surface 44 adjacent to and tangential to its periphery, i.e. the inner side of chamfer 47. A further axially directed button 52 can be inserted into surface 44 trailing in the rotational direction after the oblique peripheral reamer buttons 48-50. The buttons 51,52 are spaced from the mantle of the pilot bit 23 in order to improve during drilling the crushing work around the rim of the pilot hole.

The pilot bit 23 is in the FIG. 6 position coaxial with the guide body 10 and has forwardly a circumferential chamfer 56 carrying thereon a number of outwardly slanting peripheral pilot buttons $57,57^{I}$-$57^{iii}$ that define the diameter of the pilot hole drilled. The frontal surface of the pilot bit 23 carries a few, for example two, axially directed pilot buttons 58.

During drilling a predominating part of the drilling work falls on the two leading reamer buttons 51,48 of the eccentric bit 22. Study of the wear of the pilot portion shows that the load acting on these buttons tends to turn the back of the eccentric bit 22 in the rotational direction (arrow 8) with the buttons 51,48 as center. This results in a high radial pressure in a direction diametrically opposite to the buttons 51,48, a load that is taken up by the pilot hole and the centering mantle surface of the pilot bit 23 in the quadrant or peripheral section of the pilot bit 23 opposite to the buttons 51,48. In that section (between the buttons $57,57^{I}$ in FIG. 6) therefore no diameter cutting buttons can be allowed since the radial load otherwise would rapidly cause a deviation of the pilot hole in a direction that in due course would reduce the maximum diameter cut by the eccentric bit 22, so that the casing tube finally would become stuck. Wear on the corresponding peripheral portion of the pilot bit 23 has an analogous effect and therefore the centering mantle face of the pilot bit 23 at said forward portion is provided with one or a few gauging buttons 59, preferably two coplanar blunt buttons of hard metal as shown in the example. The pilot bit 23 must have a length assuring that a sufficient guiding surface is provided around the bottom of the pilot hole spaced in front of its substantially funnel shaped mouth that is crushed up and widened by the reamer buttons 51,52.

Flushing medium, for example exhaust air from the downhole drill, is supplied to a passage 62 in the guide body 10 and led to branch passages terminating in ejector openings 72 between the axial abutments 15 of the guide member 10, as well as on to a passage 63 in the drill bit 20. From there the supply is continued to branch passages terminated by openings 64,65 on the front surface 44 of the eccentric bit 22, to ejector branch passages directed rearwards each into an axial groove 66,67 on the mantle 45 of the eccentric bit 22, to a branch passage terminated by an opening 68 in the front of the pilot bit 23, as well as into a further branch passage terminated by opening 69, FIG. 1,3, for flushing clean the area in front of shoulder 33.

There are provided external flushing grooves 70,71 on the guide member 10 adapted to lead the outflow of flushing medium and debris from the hole during drilling into the casing tube 11. One of these grooves 70 extends from front to rear of the guide member 10. Preferably three further grooves 71 are open towards said rear while ending blindly into the periphery of the guide member 10 spaced from the front 39 of its guide potion 12. B retraction of the guide member 10 its front enters the casing tube 11. That closes the blind grooves 71 and an intensified flushing is thus possible via the sole open groove 70 that extends from front to rear of the guide member 10.

The cutting front 40 of the bit portion 22 is flushed rotatively in counter flow to the rotational drilling direction (arrow 8) on via an axial notch 73 towards open groove 70. The active area of the latter can be increased by a frontal connecting notch 75 opening one of the adjacent blind grooves 71 permanently to the outflow. An axial guide groove 74 in the pilot bit 23, FIG. 5, and partly in the rotationally leading flank of the eccentric bit 22 is in its drilling position directed towards the open groove 70 for enhancing material transportation therethrough.

The general operation, flushing and use of the drilling tool will be evident from the above. A more extensive description is offered in the copending U.S. Pat. applications 07/503,724, now the U.S. Pat. Nos. 5,009,274 and 07/503,813, both filed on April 3, 1990, and claiming equal priority date with the present application from the respective Swedish patent applications 8901198-5 and 8901200-9.

The invention is not restricted to the described preferred drilling tool but can be modified and applied in the drilling tool variants referred-to at the outset of this description, in particular in the button insert drilling tool variant U.S. Pat. No. 4,440,244, or in other applications, all within the scope of the appended claims.

I claim:

1. Eccentric drilling tool for combined rotary and percussive drilling in earth and in rock covered by overburden concurrently with a casing tube (11) following the drilling tool downhole, said tool comprising a guide member (10) rotatably centered by the mouth of said casing tube (11), a pilot bit (23) having frontal quadrants, said pilot bit positioned at the forward end of said tool supported by said guide member (10) and provided with a plurality of axially oriented hard metal pilot insert means (57, $57^{I}$-$57^{III}$) peripherally thereon directed to define the diameter of the pilot hole to be cut during drilling, a laterally extending eccentric bit (22) behind said pilot bit (23) on said tool and having a plurality of axially oriented hard metal reamer insert means (48-51) at an eccentric top thereon directed to ream up the pilot hole the maximum diameter of the hole drilled, said eccentric bit (22) being movably supported relative to said guide member (10) between a drilling position, in which the eccentric bit (22) projects laterally beyond said casing tube (11) so as to drill jointly with said pilot bit (23) a hole larger than said casing tube (11), and a retracted position, in which the drilling tool can be retracted or lowered through the casing tube (11), and one of the frontal quadrants of the pilot bit (23) being void of peripheral diameter cutting pilot inserts, said diametrical non-cutting quadrant being disposed diametrically opposite to the reamer insert means (48, 51) of the eccentric bit (22) that leads in the rotational direction (8) of the tool.

2. Eccentric drilling tool according to claim 1, wherein said pilot and reamer insert means are hard metal button inserts, said leading reamer button means being two radially staggered reamer buttons (48,51) on the top portion of the eccentric bit (22) jointly reaming up the hole to its full diameter.

3. Eccentric drilling tool according to claim 1, wherein said pilot and said reamer insert means are hard metal button inserts, said hard metal button inserts include peripheral reamer buttons and the top of said eccentric bit (22) has a peripheral chamfer (47) thereon that supports said peripheral reamer buttons (48–50) in an outwardly slanted disposition, the pilot bit (23) having a peripheral chamfer (56) thereon on which the frontal quadrants except said one diametrical non-cutting quadrant have similarly slanted peripheral pilot buttons (57, $57^{I}$–$57^{III}$).

4. Eccentric drilling tool according to claim 1, wherein the mantle of said pilot bit (23) pertaining to said one quadrant is provided with wear resistant gauging means (59) for resisting during drilling radial deviation and wear of said pilot bit (23) in said mantle region thereof.

5. Eccentric drilling tool according to claim 3, wherein said pilot bit (23) on the mantle portion thereof behind said one quadrant is provided with at least one radial gaugaing button (59) flush with said mantle portion.

6. Eccentric drilling tool according to claim 3, wherein a reamer button (51) on the front surface (44) of said eccentric bit (22) is provided adjacent to said chamfer (47) thereof in a position leading in the rotational direction of said tool and preceding the leading button (48) on said chamfer (47).

7. Eccentric drilling according to claim 3, wherein said pilot bit (23) frontally has fewer buttons on the half thereof opposite to the peripheral diameter cutting reamer buttons (48–50).

8. Eccentric drilling tool according to claim 1, wherein said pilot and eccentric bits (23,22) are integral with a shaft (21) pivotally journalled between said drilling and retracting positions in an eccentric bore (24) in said guide member (10).

9. Eccentric drilling tool according to claim 8, wherein the axis of said hole (24), is parallel to the axis (16) of said guide member (10) and is spaced laterally relative thereto a distance equal to the distance between the axes (18,17) of respectively said pilot bit (23) and said shaft (21).

10. Eccentric drilling tool according to claim 3, wherein said pilot and eccentric bits (23,22) are integral with a shaft (21) pivotally journalled between said drilling and retracting positions in an eccentric bore (24) in said guide member (10).

11. Eccentric drilling tool according to claim 10, wherein the axis of said hole (24), is parallel to the axis (16) of said guide member (10) and is spaced laterally relative thereto a distance equal to the distance between the axes (18,17) of respectively said pilot bit (23) and said shaft (21).

12. Eccentric drilling tool according to claim 1, further including axially oriented hard metal insert means (58) on the face of said pilot bit (23) for the axial penetration thereof.

* * * * *